United States Patent [19]

Tighe

[11] Patent Number: 4,531,302

[45] Date of Patent: Jul. 30, 1985

[54] REPLACEMENT EDGE DRAFTING APPARATUS

[76] Inventor: Leon Tighe, 206 W. Squantum St., North Quincy, Mass. 02171

[21] Appl. No.: 603,124

[22] Filed: Apr. 23, 1984

Related U.S. Application Data

[63] Continuation of Ser. No. 375,187, May 5, 1982, abandoned.

[51] Int. Cl.[3] ..... B43L 7/00

[52] U.S. Cl. ..... 33/483; 33/484; 33/492

[58] Field of Search ..... 33/478, 479, 483, 484, 33/489, 491, 492, 493

[56] References Cited

U.S. PATENT DOCUMENTS

| | | | |
|---|---|---|---|
| 2,182,027 | 12/1939 | Little | 33/492 |
| 2,366,449 | 1/1945 | Keuffel et al. | 33/493 |
| 2,522,908 | 9/1950 | Szabo | 33/489 |
| 2,567,554 | 9/1951 | Davey | 33/492 |
| 3,178,826 | 4/1965 | Aisen | 33/492 |
| 3,507,045 | 4/1970 | Rives | 33/491 |

FOREIGN PATENT DOCUMENTS

| | | | |
|---|---|---|---|
| 919388 | 3/1947 | France | 33/492 |
| 345462 | 5/1960 | Switzerland | 33/492 |

*Primary Examiner*—Richard R. Stearns
*Attorney, Agent, or Firm*—Lahive & Cockfield

[57] ABSTRACT

A replacement edge drafting device attaches to a drafting rule having a damaged edge and provides a new edge in place of the damaged edge. The device has an elongated body formed with a drawing section that provides the new edge and with an attachment section that joins the body to the damaged drafting rule.

5 Claims, 3 Drawing Figures

REPLACEMENT EDGE DRAFTING APPARATUS

This is a continuation of application Ser. No. 375,187, filed May 5, 1982, and now abandoned.

BACKGROUND

This invention relates to drafting equipment. More particularly, it provides a device that attaches to a drafting rule and provides a fresh drawing edge for use in place of the damaged edge of the rule.

The invention thus provides a low-cost device for ready attachment to a drafting rule having a worn or otherwise damaged edge, and provides a new drawing edge of superior quality.

One common drafting rule is a parallel rule, which is a standard drafting device in wide use, including by architects, designers and engineers. As the drawing edge of the rule becomes worn, nicked and otherwise damaged, one cannot rely on it to draw a continuous straight line. Refinishing or replacement of the drawing edge is not readily found; neither refinishing businesses nor replacement parts are generally available. Further, such repair requires that the parallel rule be disassembled from the drafting table, and then reassembled with careful alignment. In the interim, the drawing station which relies on the rule is essentially out of service.

It accordingly is an object of this invention to provide apparatus for renewing the drawing edge of a parallel rule.

Another object is to provide a replacement edge drafting device which can be readily installed with little loss of time and with relatively little skill.

It is a further object to provide a drafting edge replacement device of the above character that provides a drawing edge of professional quality at relatively low cost.

Other objects of the invention will in part be obvious and will in part appear hereinafter.

SUMMARY

A replacement edge drafting device according to this invention is an elongated article which adhesively mounts directly on a worn or otherwise damaged parallel rule in a manner that disposes a new drawing edge of the replacement device ready for use in place of the worn edge. The lower surface of the replacement device carries a mounting adhesive, and is adjacent to an alignment surface that abuts the original drawing edge. This abutment aligns the replacement edge with the damaged original edge. A further bottom surface of the device, located between the attachment surface and the new replacement drawing edge, overlies the drawing surface. The structure of the replacement device which provides this surface is transparent for viewing lines and legend on the drawing which lie below this surface.

An attachment section of the device forms the foregoing attachment and alignment surfaces. Forward of the attachment surface is a transparent section that has a frontal surface which forms the replacement drawing edge surface and that has a bottom surface which overlies the drawing.

The replacement edge device preferably also has an upwardly projecting rim, typically on the attachment section, which the user can readily grasp for positioning the rule with its replacement edge. The provision of this rim on the device provides a handle-like structure close to the new drawing edge, as is often considered desirable.

The replacment edge device which the invention provides can be manufactured at relatively low cost and yet with ample precision and finished surfaces. One manufacture employs extrusion of a synthetic resin to form the body of the replacement edge device. The application of pressure-sensitive adhesive to the attachment surface of the extruded device, together with whatever finishing steps are desired, completes the manufacture. The adhesive typically is provided as a double-sided adhesive tape, with a peel-off protective layer on the exposed mounting face.

The invention accordingly comprises an article of manufacture possessing the features, properties, and the relation of elements which will be exemplified in the article hereinafter described, and the claims indicate the scope of the invention.

For a fuller understanding of the nature and objects of the invention, reference should be made to the following detailed description and the accompanying drawings in which.

DESCRIPTION OF ILLUSTRATIVE EMBODIMENT

Figure 1:
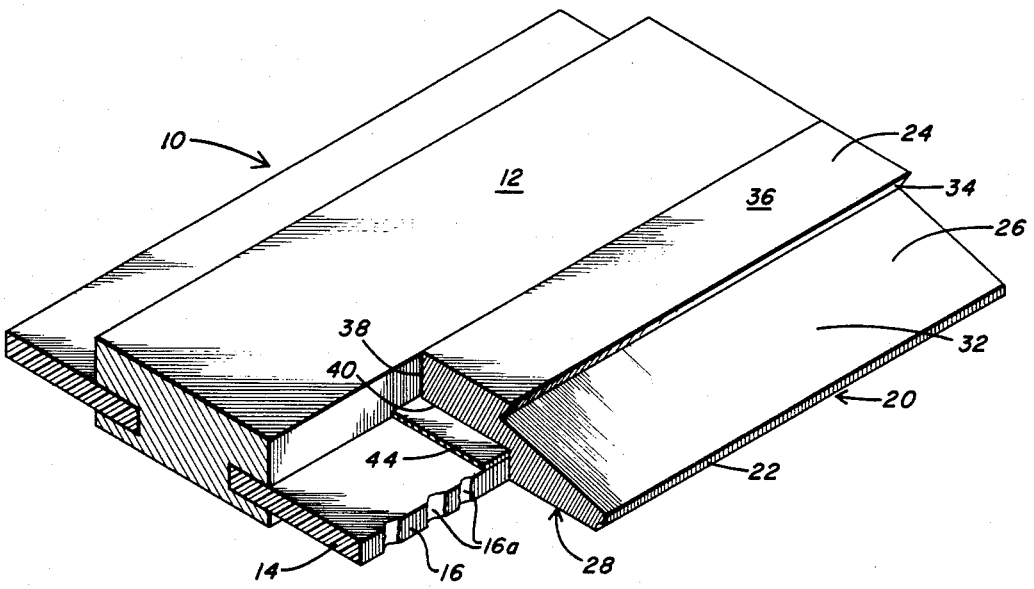
FIG. 1 is a fragmentary perspective view of a drafting parallel rule with a replacement edge device attached thereto.

With reference to FIG. 1, a conventional drafting parallel rule 10 typically has a structural rail 12 in which is seated an elongated, transparent strip 14. The rail 12 typically is of wood or plastic and the strip 14 of clear plastic. The exposed outer edge 16 of the strip forms a drawing edge, along which the user guides a pen or pencil to inscribe a continuous straight line on the paper or other drawing surface which lies directly below the rule. Invariably, however, nicks, dents and other damage, illustrated at 16*a*, destroy the finished continuous flat drawing edge 16. A pen or pencil guided along such a damaged edge cannot inscribe a continuous straight line.

FIG. 1 further shows that the invention resolves this problem by providing a replacement edge drafting device 20 that mounts directly on the old rule 10 and provides a new drawing edge 22 precisely parallel to, and slightly forward of, the original edge 16.

The illustrated replacement device 20 has a relatively thin, elongated body formed with an attachment section 24 that is parallel and side-by-side to a drawing section 26. These two sections are contiguous with one another, typically being formed of a single structural element.

Figure 2:
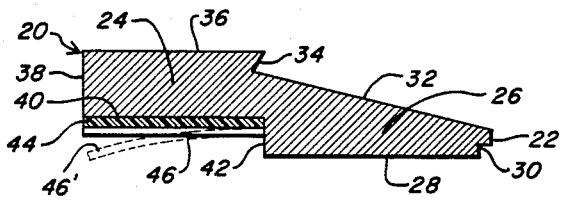
FIG. 2 is a transverse cross-sectional view of the replacement edge device of FIG. 1.

As shown in FIGS. 1 and 2, the frontmost surface of the drawing section 26 is the replacement drawing edge 22. It is finished to be straight and flat, i.e. planar, with no surface curvations. The width of the edge 22 extends along the thickness dimension of the replacement device 20 and correspondingly of the drawing section 26.

A bottom surface 28 of the drawing section is extended along the width dimension of the section and is oriented transverse to the drawing edge 22 for facing downward onto a drawing surface, i.e. a surface lying below the device 20. The top of the drawing section 26 is a smooth flat bevelled upper surface 32. The material of the drawing section between the surfaces 28 and 32 preferably is optically transparent, if not optically clear, so that a user can view the indicia and lines on a drawing line below the bottom surface 28 through this portion of the replacement device 20. The bevel 32 extends along the width dimension of the device from the replacement edge 22 to an angled edge 34 of rim 36 on the top of the attachment section 24.

A reveal 30 extends along the replacement device 20 at the juncture between the replacement drawing edge 22 and the bottom surface 28. As conventional in transparent drawing edges, the reveal 30 keeps ink from blotting under the bottom surface 28.

With further reference to FIGS. 1 and 2, the angled surface 34 at the front of the upstanding rim 36 together provides a finger-grip which enables a user to grasp the replacement device for positioning the complete parallel rule 10 to which the replacement device 20 is attached. In the illustrated construction, the top surface of the rim 36 is a flat surface parallel to the bottom surface 28, and the device back surface 38 likewise is flat and extends parallel to the frontal drawing edge 22. This configuration matches the structure of the rule 10, i.e. the front edge of the rail 12 and the upper surface of the strip 14, against which the device 20 seats. The rim 36, including the surfaces 34 and 38, are typically part of the attachment section 24 of the replacement device 20, as illustrated. Further, the top of the rim 36 of the device 20 is illustrated as being essentially flush with the top of the rail 12, after assembly. This is considered preferable, but other arrangements, e.g. a recessed rim or a protruding one, can be employed.

The remaining structural elements of the illustrated replacement device of FIG. 2 are a mounting surface 40 and an alignment surface 42. The mounting surface 40 is parallel to the bottom surface 28 and is recessed relative to it. The width of the mounting surface, which is aligned with the width of the device, preferably is close to but is not greater than the projecting width of the strip 14 on which the device 20 mounts, as FIG. 1 shows. The mounting surface 40 carries a pressure-sensitive adhesive 44 for attaching the device 20 to the parallel rule 10 at the protruding strip 14, as also shown. This adhesive layer 44 has a protective peel-off film 46, shown in FIG. 2, that is removed to expose the layer for adhesively mounting the device onto the rule 10. The layer of adhesive 44 typically is provided in the form of a two-sided adhesive tape, one side of which is secured to the mounting surface 40. The other side is initially covered by the protective film 46.

The aligning surface 42 is, as seen in FIG. 2, located intermediate the drawing section 26 and the mounting surface 40, and spans between the bottom surface 28 and the mount 40. It abuts against the damaged drawing edge 16 that is being replaced and accordingly the replacement drawing edge 22 is in close parallel geometry with the aligning surface 42. The width of the aligning surface 42 preferably is determined at least in part by the width of the original drawing edge 16 which is being replaced. In a preferred practice of the invention, the width of the alignment surface 42 is at least equal to and preferably fractionally greater than the width of the drawing edge 16, as FIG. 1 illustrates. This geometry locates the bottom surface 28 of the replacement device closely spaced above the drawing surface which the parallel rule overlies.

A replacement edge drafting device having the foregoing construction can readily be manufactured with smooth finished surfaces to precise tolerances of acrylic or similar synthetic resin material for providing a high quality edge on a worn or otherwise damaged drafting rule. The replacement device is readily installed in a matter of minutes, without in any way disassembling or otherwise changing the installment or alignment of the parallel rule.

Figure 3:
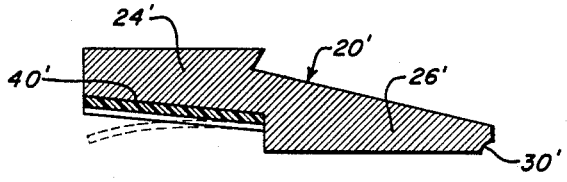
FIG. 3 is a view similar to FIG. 2 of a modified form of the device of the invention.

FIG. 3 shows a replacement edge device 20', similar to that described above, but in which the mounting surface 40' is canted. This configuration matches a drafting rule on which the drawing edge is at the front of a canted strip. This modified construction also has a rounded reveal 30', in place of the square-cornered reveal of FIG. 2.

The drafting device described above efficiently attains the objects set forth above, among those made apparent from the preceding description. Since certain changes may be made in the above article without departing from the scope of the invention, it is intended that all matter contained in the above description or shown in the accompanying drawing be interpreted as illustrative and not in a limiting sense.

It is also understood that the following claims are intended to cover all generic and specific features of the invention herein described, and all statements of scope of the invention which, as a matter of language, might be said to fall therebetween.

Having described the invention, what is claimed as new and secured by Letters Patent is:

1. In drafting rule apparatus having an elongated strip element with a damaged outer first drawing edge, an improvement providing a renewed drawing edge, said improvement comprising A. an elongated body secured to said strip element and having an attachment section parallel to and side-by-side with a drawing section, B. said drawing section having a planar frontmost surface extending along the thickness dimension of said section and forming a replacement drawing edge, and having a bottom surface extending along the width dimension of said drawing section and oriented transverse to said frontmost surface for facing a drawing surface over which the drafting rule may be placed, C. said attachment section having an attachment surface disposed for mounting said body on the rule, said attachment surface extending along the width dimension of said attachment section and facing in the same direction as said bottom surface, and D. adhesive means adhesively joining said attachment surface to said strip element for securing said body to the drafting rule, E. said attachment section further having a planar alignment surface parallel to said frontmost surface and facing oppositely thereto, said alignment surface being located intermediate said bottom surface and said attachment surface and being arranged for abutment against the drawing edge of the aforesaid rule to which said body is joined, so that said replacement drawing edge is aligned parallel to said damaged first drawing edge.

2. In apparatus according to claim 1, the further improvement wherein

A. said attachment surface is recessed relative to said bottom surface,

B. said alignment surface extends between said attachment surface and said bottom surface, and C. at least said attachment section is relatively optically transparent.

3. In apparatus according to claim 1, the further improvement wherein said attachment section has at the top thereof, opposite said attachment surface thereof, means forming an upstanding finger-grip for positioning of the rule apparatus by a user.

4. Apparatus for renewing the drawing edge on a drafting rule, said apparatus comprising A. an elongated body with an attachment section parallel to and side-by-side with a drawing section, B. said drawing section having a planar frontmost surface extending along the thickness dimension of said section and forming a replacement drawing edge, and a bottom surface extending along the width dimension of said section and oriented transverse to said frontmost surface for facing a drawing surface, C. said attachment section having a width dimension and having an attachment surface facing in the same direction as said bottom surface, said attachment surface extending along the width dimension of said attachment section, and further having rim means longitudinally extending therealong and having a projecting frontal surface extending along the thickness dimension of said section and arranged for manual rule-positioning engagement, and D. pressure sensitive adhesive means carried on said attachment surface for adhesively joining said body to a drafting rule, E. said attachment section further having a planar alignment surface parallel to said drawing edge surface and facing oppositely thereto, and arranged for abutment against the drawing edge of the aforesaid rule to which said body is joined.

5. A method for renewing the drawing edge on a drafting rule, said method comprising the steps of A. providing a replacement-edge device having an elongated body with an attachment section parallel to and extending side-by-side with a drawing section, B. providing said drawing section with a planar frontmost surface extending along the thickness dimension of said section and forming a replacement drawing edge, and with a bottom surface extending along the width dimension of said drawing section and oriented transverse to said frontmost surface for facing a drawing surface over which the drafting rule amy be placed, C. providing said attachment section with an attachment surface extending along the width dimension of said section and facing in the same direction as said bottom surface, D. further providing said attachment section with a planar alignment surface parallel to said frontmost surface and facing oppositely thereto, E. disposing said replacement edge device, relative to a drafting rule having a worn drawing edge, with said attachment surface overlying the drafting rule and with said alingment surface in abutment against the drawing edge of the drafting rule, and F. adhesively joining said attachment surface to the drafting rule with said alignment surface in abutment against the worn drawing edge, thereby to dispose said replacement drawing edge parallel to the worn drawing edge.

* * * * *